US009320313B2

(12) United States Patent
Craig et al.

(10) Patent No.: US 9,320,313 B2
(45) Date of Patent: Apr. 26, 2016

(54) SPLIT-SOLE FOOTWEAR

(71) Applicant: Nike, Inc., Beaverton, OR (US)

(72) Inventors: Kenneth T. Craig, Beaverton, OR (US); Elizabeth Langvin, Sherwood, OR (US); Damon Clegg, Hood River, OR (US); Donald R. Reardon, Portland, OR (US); Christopher L. Favela, San Diego, CA (US)

(73) Assignee: NIKE, Inc., Beaverton, OR (US)

( * ) Notice: Subject to any disclaimer, the term of this patent is extended or adjusted under 35 U.S.C. 154(b) by 285 days.

(21) Appl. No.: 13/771,503

(22) Filed: Feb. 20, 2013

(65) Prior Publication Data

US 2014/0230284 A1 Aug. 21, 2014

(51) Int. Cl.

| | |
|---|---|
| ***A43B 3/12*** | (2006.01) |
| ***A43B 3/00*** | (2006.01) |
| ***A43B 5/00*** | (2006.01) |
| ***A43B 13/16*** | (2006.01) |
| ***A43B 7/26*** | (2006.01) |
| *A43B 5/12* | (2006.01) |

(52) U.S. Cl.

CPC ... *A43B 3/00* (2013.01); *A43B 3/12* (2013.01); *A43B 3/126* (2013.01); *A43B 5/00* (2013.01); *A43B 7/26* (2013.01); *A43B 13/16* (2013.01); *A43B 3/0052* (2013.01); *A43B 5/12* (2013.01)

(58) Field of Classification Search

CPC ..... A43B 3/0052; A43B 3/12; A43B 3/126; A43B 5/12; A43B 7/26

USPC ..... 36/103, 88, 94, 7.5, 7.6, 8.3, 11.5; 2/239

See application file for complete search history.

(56) References Cited

U.S. PATENT DOCUMENTS

| | | | | |
|---|---|---|---|---|
| 1,204,796 | A | 11/1916 | Lockwood | |
| 1,458,497 | A | 6/1923 | Perkins | |
| 1,552,946 | A | 9/1925 | Perkins | |
| 2,252,315 | A | 8/1941 | Doree | |
| 2,362,010 | A | 11/1944 | Huff | |
| 2,669,036 | A | 2/1954 | Israel | |
| 2,711,033 | A * | 6/1955 | Dick | 36/11.5 |
| 2,780,013 | A | 2/1957 | Voss | |
| 4,120,103 | A | 10/1978 | Colby | |
| 4,541,186 | A | 9/1985 | Mulvihill | |
| 4,944,099 | A | 7/1990 | Davis | |
| 5,623,734 | A * | 4/1997 | Pugliatti | 2/239 |
| 5,682,685 | A | 11/1997 | Terlizzi | |
| 5,689,901 | A | 11/1997 | Bell et al. | |
| 5,749,100 | A * | 5/1998 | Rosenberg | 2/239 |
| 5,913,592 | A * | 6/1999 | Moore | 36/8.1 |
| 5,956,868 | A | 9/1999 | Stevens et al. | |
| 6,021,585 | A * | 2/2000 | Cole | 36/11.5 |
| 6,237,250 | B1 * | 5/2001 | Aguerre | 36/11.5 |
| 6,256,906 | B1 * | 7/2001 | Matis et al. | 36/11.5 |
| 6,634,121 | B2 | 10/2003 | Sordi | |
| 6,694,641 | B1 * | 2/2004 | Gill | 36/11.5 |
| D487,334 | S | 3/2004 | Issler | |

(Continued)

*Primary Examiner* — Khoa Huynh
*Assistant Examiner* — Jocelyn Wu
(74) *Attorney, Agent, or Firm* — Plumsea Law Group, LLC.

(57) ABSTRACT

An article of footwear including a textile upper and a split sole, the split sole having a forefoot portion and a heel portion separated by a gap under the instep portion of the article of footwear. An x-shaped bridge arches over the wearer's foot and connects the forefoot portion of the split sole to the heel portion of the split sole. The article of footwear is fabricated using injection molding to impregnate the fabric at the bottom of the textile upper and to form the split sole.

22 Claims, 12 Drawing Sheets

(56) References Cited

U.S. PATENT DOCUMENTS

| | | | | |
|---|---|---|---|---|
| D517,784 | S | 3/2006 | Wilkenfeld et al. | |
| 7,082,703 | B2 | 8/2006 | Greene et al. | |
| D538,515 | S | 3/2007 | Wilkenfeld et al. | |
| D556,436 | S | 12/2007 | Wilkenfeld et al. | |
| 7,337,558 | B2 | 3/2008 | Terlizzi et al. | |
| 7,437,838 | B2 * | 10/2008 | Nau | 36/102 |
| 7,685,740 | B2 | 3/2010 | Sokolowski | |
| 7,966,747 | B2 | 6/2011 | Wilkenfeld et al. | |
| 8,146,273 | B2 | 4/2012 | Sokolowski | |
| 8,151,490 | B2 | 4/2012 | Sokolowski | |
| 8,215,038 | B1 * | 7/2012 | Sattler et al. | 36/135 |
| 8,250,780 | B1 * | 8/2012 | Diaz | 36/11.5 |
| 8,381,415 | B1 * | 2/2013 | Lanoue et al. | 36/11.5 |
| 2002/0078591 | A1 | 6/2002 | Morrone | |
| 2002/0100189 | A1 * | 8/2002 | Manzi | 36/100 |
| 2003/0074806 | A1 * | 4/2003 | Urie et al. | 36/11.5 |
| 2003/0145491 | A1 * | 8/2003 | Udugama | 36/23 |
| 2003/0172555 | A1 * | 9/2003 | Chu | 36/113 |
| 2003/0226281 | A1 * | 12/2003 | Carlton | 36/7.6 |
| 2003/0230006 | A1 * | 12/2003 | Dombowsky | 36/7.6 |
| 2003/0230007 | A1 * | 12/2003 | Walton | 36/15 |
| 2004/0128863 | A1 * | 7/2004 | Hong et al. | 36/100 |
| 2005/0166427 | A1 * | 8/2005 | Greene et al. | 36/128 |
| 2005/0193588 | A1 * | 9/2005 | Dombowsky | 36/7.5 |
| 2005/0268485 | A1 * | 12/2005 | Sakai | 36/11.5 |
| 2006/0000112 | A1 * | 1/2006 | Chien | 36/11.5 |
| 2006/0026861 | A1 * | 2/2006 | Manzi | 36/11.5 |
| 2006/0196078 | A1 * | 9/2006 | Terlizzi et al. | 36/8.3 |
| 2007/0022629 | A1 * | 2/2007 | Bathum | 36/11.5 |
| 2007/0277394 | A1 * | 12/2007 | Hansen et al. | 36/8.3 |
| 2007/0283597 | A1 * | 12/2007 | Logan | 36/91 |
| 2008/0034613 | A1 * | 2/2008 | Wilkenfeld | A43B 3/06 36/8.3 |
| 2008/0155856 | A1 * | 7/2008 | Bathum | 36/11.5 |
| 2008/0189984 | A1 * | 8/2008 | Januszewski et al. | 36/100 |
| 2008/0244932 | A1 * | 10/2008 | Nau | 36/102 |
| 2008/0263893 | A1 * | 10/2008 | Hernandez | 36/1 |
| 2009/0031584 | A1 * | 2/2009 | Rasmussen et al. | 36/88 |
| 2009/0265954 | A1 * | 10/2009 | Goldberg | 36/11.5 |
| 2010/0257750 | A1 * | 10/2010 | Bell et al. | 36/7.6 |
| 2011/0061149 | A1 * | 3/2011 | Polacco et al. | 2/241 |
| 2011/0173843 | A1 * | 7/2011 | Bishop | 36/92 |
| 2011/0179674 | A1 * | 7/2011 | Heid | 36/91 |
| 2011/0203137 | A1 | 8/2011 | Long et al. | |
| 2011/0265253 | A1 * | 11/2011 | Juza et al. | 2/245 |
| 2012/0255201 | A1 | 10/2012 | Little | |
| 2013/0111781 | A1 * | 5/2013 | Jaeger et al. | 36/43 |
| 2013/0333243 | A1 * | 12/2013 | Dushey et al. | 36/94 |
| 2014/0033567 | A1 * | 2/2014 | Heathcote et al. | 36/92 |
| 2014/0101969 | A1 * | 4/2014 | Pham | 36/11.5 |

* cited by examiner

SPLIT-SOLE FOOTWEAR

BACKGROUND

The present embodiments relate to an article of footwear, and in particular to an article of footwear having a split-sole configuration for use in athletic activities.

Typical athletic shoes have two major components, an upper that provides the enclosure for receiving the foot, and a sole secured to the upper. The upper is generally adjustable using laces or other fastening means to secure the shoe properly to the foot. The sole has the primary contact with the playing surface. The bottom surface of the sole is generally designed for durability and traction appropriate to the particular athletic activity the shoe is designed for. The shoe must be able to absorb the shock as the shoe contacts the ground or other surfaces, and must provide the appropriate type of protection to the foot and maximize the wearer's comfort. Moreover, many athletes and recreational users place additional value in footwear that is specifically designed for the particular activity they are engaged in, in order to maximize performance, durability and comfort.

SUMMARY

This summary is intended to provide an overview of the subject matter of the present embodiments, and is not intended to identify essential features or key elements of the subject matter, nor is it intended to be used to determine the scope of the claimed embodiments. The proper scope of the embodiments may be ascertained from the detailed description of the embodiments provided below, the figures referenced therein and the claims.

Embodiments of the article of footwear are flexible split-sole footwear suitable for beach volleyball, Frisbee® beach games, other sand sports, and similar activities. In one aspect, the article of footwear includes a sock upper component (for example a textile sock upper component), a split sole having a forefoot portion and a heel portion separated by a gap, and an x-shaped bridge configured to arch over a wearer's instep. The x-shaped bridge connects the forefoot portion of the split sole to the heel portion of the split sole by extending arms to arch over the wearer's instep to connect with the forefoot portion on its lateral side, the forefoot portion on its medial side, the heel portion on its lateral side and the heel portion on its medial side. The article also includes lateral and medial protective forefoot elements configured to curve around and over the sides and front of the wearer's foot to provide protection for the wearer's foot, leaving a substantial opening at the dorsal surface of the foot. The article of footwear is formed as a unitary component with the split sole integrally attached to the textile sock upper component.

In another aspect, the article of footwear includes a textile sock upper component, and an integral split sole having a forefoot portion and a heel portion separated by a gap configured to lie beneath a wearer's instep. A back strap is configured to wrap around the wearer's heel and is attached at one end to the medial side of the heel portion and at the other end to the lateral side of the heel portion. An x-shaped bridge arches over a wearer's foot, thus forming an apex configured to lie over the wearer's instep, from which medial arms extend to a medial side of the forefoot portion of the split sole and to a medial side of the heel portion of the split sole, and lateral arms extend to a lateral side of the forefoot portion of the split sole and to a lateral side of the heel portion of the split sole. The medial arms are configured to extend in part down the side of the wearer's foot and the lateral arms are configured to extend in part over the top of the wearer's foot. The article also provides lateral and medial protective forefoot elements configured to curve around and over the sides and front of the wearer's foot to provide protection for the wearer's foot, leaving an opening at the dorsal surface of the foot. In this embodiment, the split sole is a unitary product formed by injecting mold material into a cavity having a last within the textile sock upper component defining one side of the cavity. The mold material impregnates the textile sock upper component and forms the split sole attached to the textile sock upper component.

In another aspect, the article of footwear includes a textile sock upper, and an integral split sole having a forefoot portion and a heel portion separated by a gap. The forefoot portion includes medial and lateral protective elements configured to curve over the sides and front of a wearer's foot to protect those parts of the foot, leaving an opening at the foot's dorsal surface. An x-shaped bridge is configured to fit over the wearer's foot at the wearer's instep. The x-shaped bridge has first, second, third and fourth arms extending downwards from an apex of the x-shaped bridge to attach to the forefoot portion and the heel portion of the sole. The first arm extends down to attach to the medial side of the forefoot portion, the second arm extends down to attach to the lateral side of the forefoot portion, the third arm extends down to attach to the medial side of the heel portion and the fourth arm extends down to attach to the lateral side of the heel portion. The split sole and the upper form an integral product.

In another aspect, the article of footwear includes a split sole and a textile sock upper, wherein the split sole comprises a forefoot portion and a heel portion separated by a gap. An x-shaped bridge having an apex and first, second, third and fourth arms, is configured to arch over a wearer's instep, to connect the forefoot portion of the sole to the heel portion of the sole. Specifically, the first arm attaches to a medial side of the forefoot portion, the second arm attaches to a lateral side of the forefoot portion, the third arm attaches to a medial side of the heel portion and the fourth arm attaches to a lateral side of the heel portion. The fabric sock upper comprises an ankle portion and an instep portion. The article of footwear can be fabricated by inserting a last into the fabric sock upper, positioning the last with the fabric sock upper over a mold, and injecting molding material into the mold to form the split sole.

Embodiments are flexible split-sole footwear suitable for beach volleyball, Frisbee® beach games, other sand sports, and similar activities. In one aspect, embodiments include two main components: a fabric sock upper component and a sole component. The sole is a split sole, with a forefoot portion and a heel portion, separated by a gap under the arch of the wearer's foot. The sole component includes a back strap that wraps around the wearer's heel, an x-shaped bridge that arches over the wearer's foot above the arch region to connect the forefoot and heel portions of the sole to each other, and medial and lateral side forefoot elements that curve around the sides and front of the foot to provide protection for the sides and front of the foot. The forward part of the sole has a longitudinal gap separating the portion of the forefoot of the sole under the wearer's big toe from the portion of the forefoot of the wearer under the other toes. The fabric sock is placed over a mold cavity, and the sole is formed by injection molding, such that the molding material impregnates the fabric along the bottom of the sock. Thus the shoe is fabricated without the use of adhesives. In some embodiments, the bottom of the sole includes rectangular ridges under the forefoot section and arcuate ridges under the heel section.

In another aspect, embodiments include flexible footwear comprising a sock-like textile upper and an integral split sole, wherein the integral split sole is fabricated by injecting moldable material into a mold cavity, such that the moldable material impregnates the bottom of the fabric upper to form a unitary product without the use of adhesives. The integral split sole comprises a back strap attached to both sides of the heel section of the sole, and an x-shaped bridge at the midfoot that arches down from the apex of the bridge over the wearer's foot and attaches to the medial and lateral sides of the heel portion, and to the medial and lateral sides of the forefoot portion of the sole, thus connecting the heel portion of the sole to the forefoot portion of the sole. The forefoot portion includes medial and lateral protective elements configured to curve over the sides and front of a wearer's foot.

In another aspect, embodiments of the sole include a strap that wraps around the back of the wearer's heel and is attached to both the medial and lateral sides of the heel portion of the sole.

In another aspect, embodiments of the sole include a longitudinal gap separating the portion of the forefoot under the wearer's big toe from the portion of the forefoot under the wearer's remaining toes.

In another aspect, embodiments of the sole include a separate pad under the wearer's big toe with a bottom surface that has different physical characteristics than the bottom surface of the remaining portion of the forefoot.

In another aspect, embodiments of the sole include a portion of the bottom surface of the sole under the forefoot having a textured surface with a rectangular ridge pattern.

In another aspect, embodiments of the sole include a portion of the bottom surface of the sole under the heel having a textured surface with arc-like ridges.

It is an object of the present embodiments to provide footwear for professional or amateur athletes, or for recreational players, that provides optimum performance when playing on a sand or on a similar surface.

It is another object of the present embodiments to provide footwear for professional or amateur athletes, of for recreational players, that provides the flexibility needed for activities such as beach volleyball, beach games such as Frisbee,® touch football and/or similar activities.

It is another object of the present embodiments to provide footwear for professional or amateur athletes, or for recreational players, that provides optimum contact with surfaces such as sand.

It is another object of the present embodiments to provide footwear having selected areas of the bottom of the sole with enhanced abrasion resistance.

Other structures, objects, features and advantages of embodiments will be apparent to one of ordinary skill in the art upon examination and study of the following detailed description and the accompanying figures. It is intended that all such additional structures, features and advantages be included within this description and this summary, be within the scope of the embodiments and be protected by the claims set forth below.

DETAILED DESCRIPTION OF THE EMBODIMENTS

For clarity, the detailed descriptions herein describe certain exemplary embodiments, but the disclosure herein may be applied to any article of footwear comprising certain of the features described herein and recited in the claims. In particular, the following detailed description discusses an exemplary embodiment, in the form of a sports shoe for use in sand volleyball or other similar activities, but it should be noted that the present embodiments could take the form of other articles of footwear including, but not limited to shoes used for other beach sports, water sports, canoeing and kayaking, as well as other kinds of shoes.

The term "textiles," as used throughout the detailed description and in the claims, refers to any manufacture from fibers, filaments, yarns or other materials. Textiles may be characterized by flexibility, fineness, and a high ratio of length to thickness. Textiles may include fabrics produced directly from webs of filaments or fibers by random interlocking to produce non-woven fabrics or felts, or any manufacture formed by the mechanical manipulation of yarn to produce a woven fabric.

Figure 1:
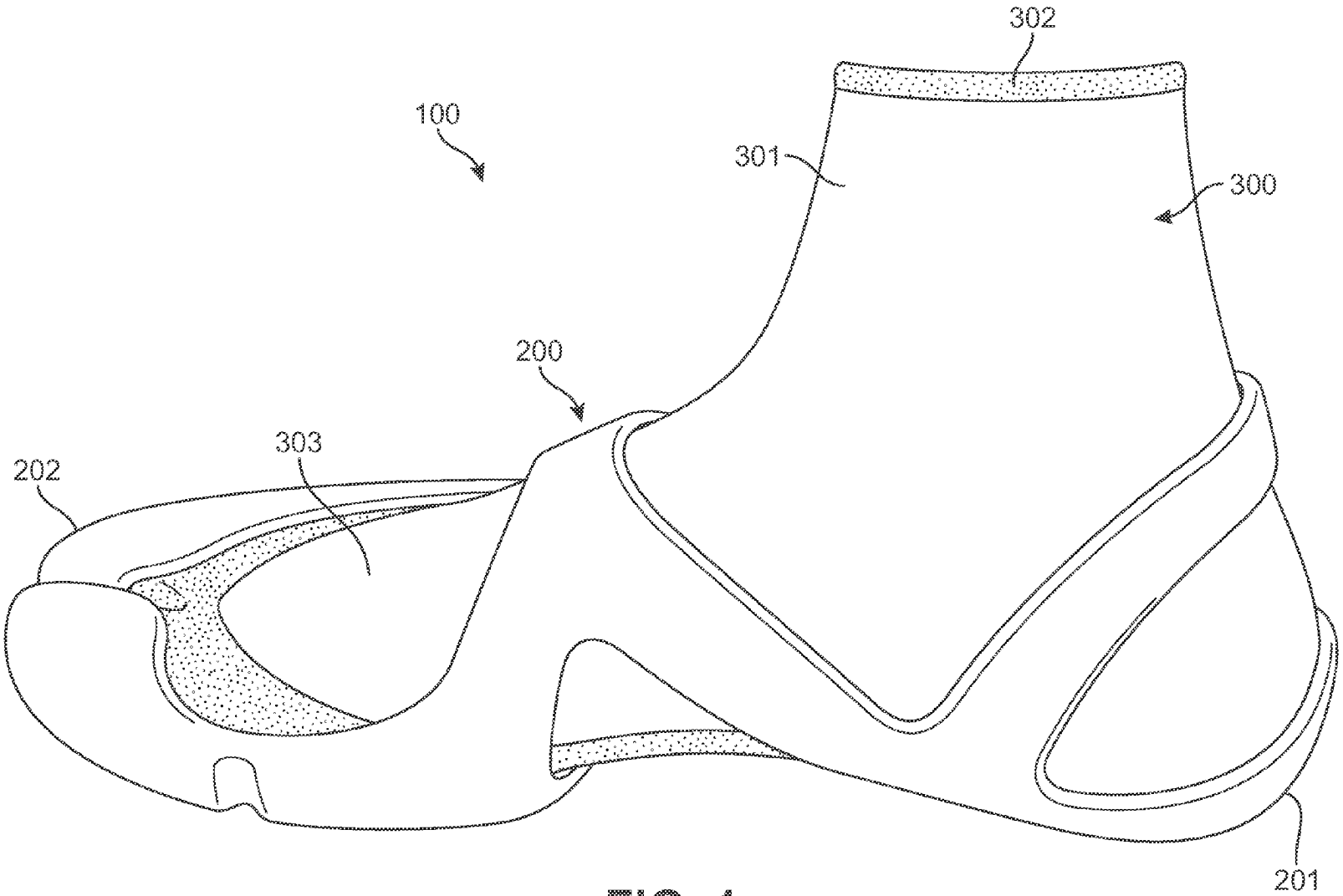
FIG. 1 is a perspective view of an embodiment of an article of footwear.

FIG. 1 is a side perspective view of an embodiment of the article of footwear 100 (also referred to herein as "article 100," for example), showing sole component 200 and sock upper component 300. Sole component 200 and sock upper component 300 may be characterized by various portions. For example, sole component 200 may include forefoot portion 202 and heel portion 201. Sock upper component 300 may include ankle portion 301 and foot portion 303. Sock upper component 300 may also be characterized by opening 302 that is configured to receive a wearer's foot.

Figure 2:
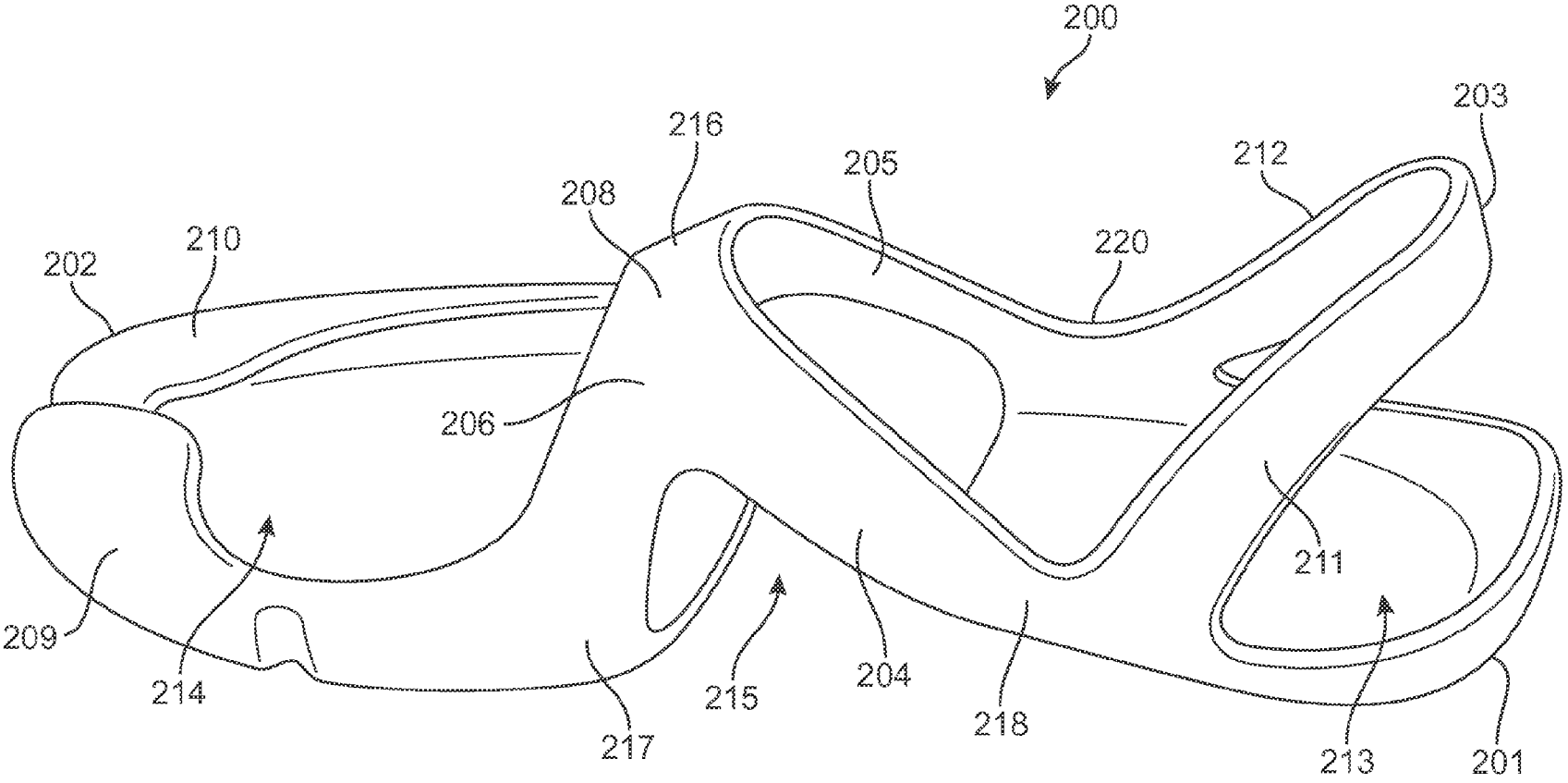
FIG. 2 is a side perspective view of an embodiment of the sole component of the article of footwear.
Figure 3:
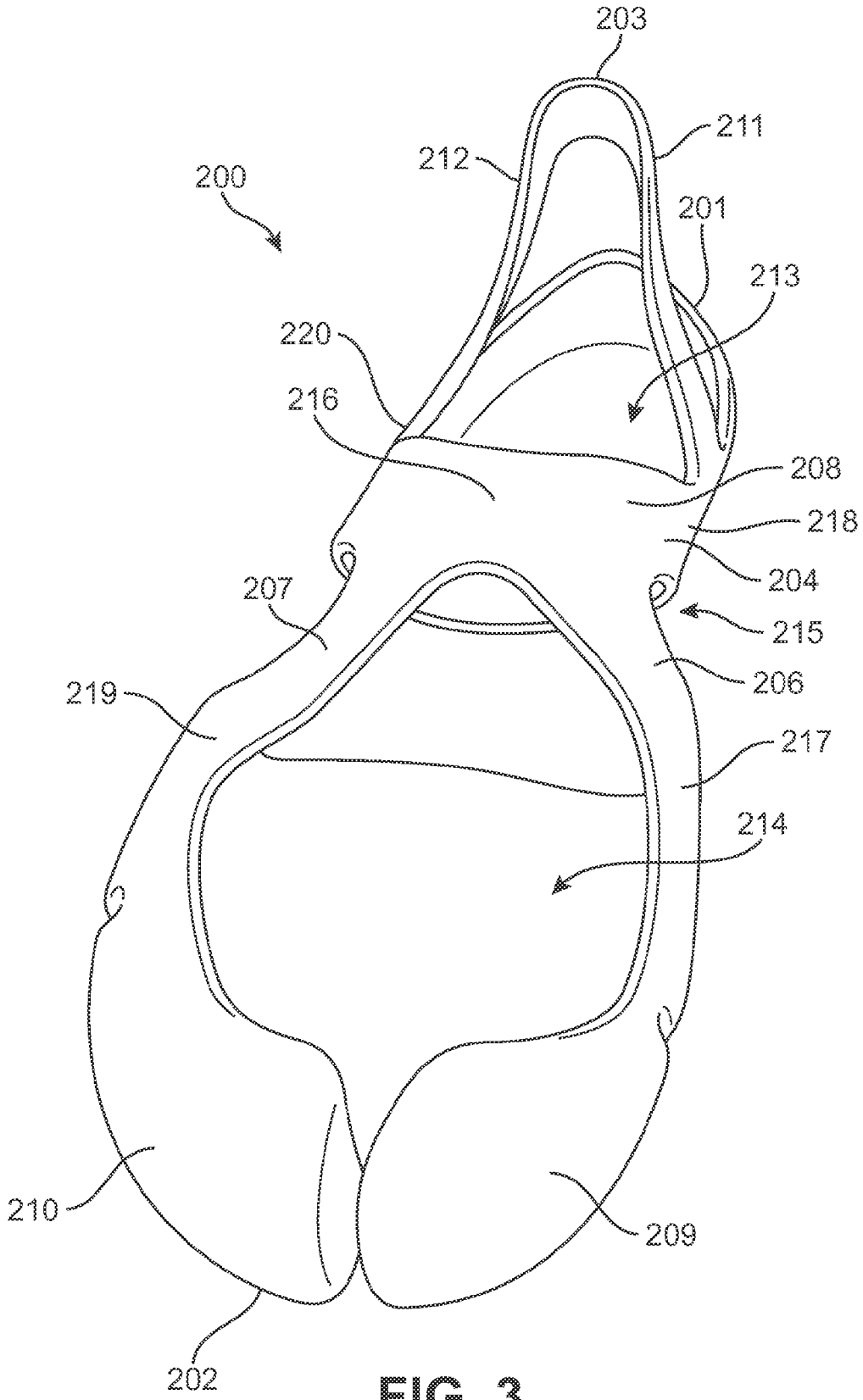
FIG. 3 is a front perspective view of an embodiment of the sole component of the article of footwear.

FIGS. 2 and 3 are perspective side and front views, respectively, of the integral sole component 200 of an embodiment of an article of footwear, showing a heel portion 201 and a forefoot portion 202. In some embodiments, heel portion 201 comprises a back strap 203 that wraps around the wearer's heel. In some embodiments, back strap 203 may further comprise a first portion 211 and a second portion 212, which are attached to the medial and lateral sides, respectively, of heel portion 201. In some embodiments, heel portion 201 also comprises heel support portion 213. Heel support portion 213 may extend from the back of the heel to the beginning of the wearer's instep, and may be dimensioned to protect the bottom of the wearer's heel.

In some embodiments, forefoot portion 202 also comprises forefoot support portion 214, which extends from the front of the wearer's instep to the front of article 100. In some embodiments, forefoot support portion 214 may be configured with one or more protective elements. In one embodiment, forefoot portion 202 comprises medial front protective element 209 and lateral front protective element 210. In some embodiments, medial front protective element 209 and lateral front protective element 210 may extend upwardly from forefoot support portion 214. In some embodiments, medial front protective element 209 and lateral front protective element 210 may curve around the side and front of the foot, thus protecting those parts of the foot that are constantly pressed down and across abrasive surfaces such as sand, while leaving the top or dorsal part of the foot open for ventilation and comfort.

As seen in FIG. 2, for example, in some embodiments sole component 200 may be configured as a split sole construction. For example, forefoot support portion 214 and heel support portion 213 may be separated from one another. In some embodiments, the split-sole construction of sole component 200 of article 100 includes a gap 215 between heel support portion 213 and forefoot support portion 214 of the footwear.

A sole component can include provisions for connecting two disjoint support portions that may be separated by a gap. In some embodiments, a sole component could include a bridge or bridge-like structure that spans the gap and provides a means of connecting a forefoot support portion and a heel support portion. In some embodiments, the bridge or bridge-like member could be configured to arch over a gap.

Figure 6:
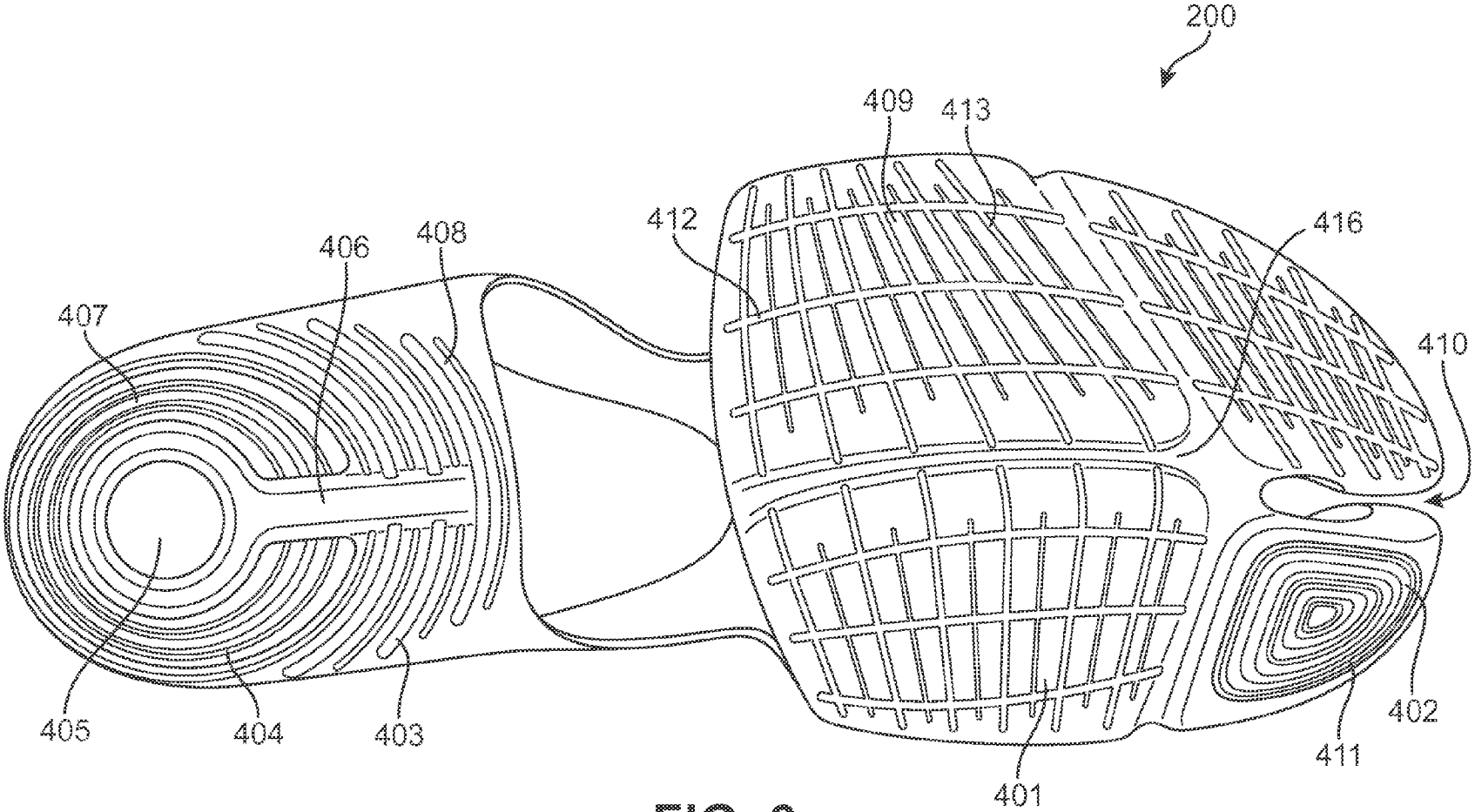
FIG. 6 is a bottom view of an embodiment of the sole component of the footwear.
Figure 8:
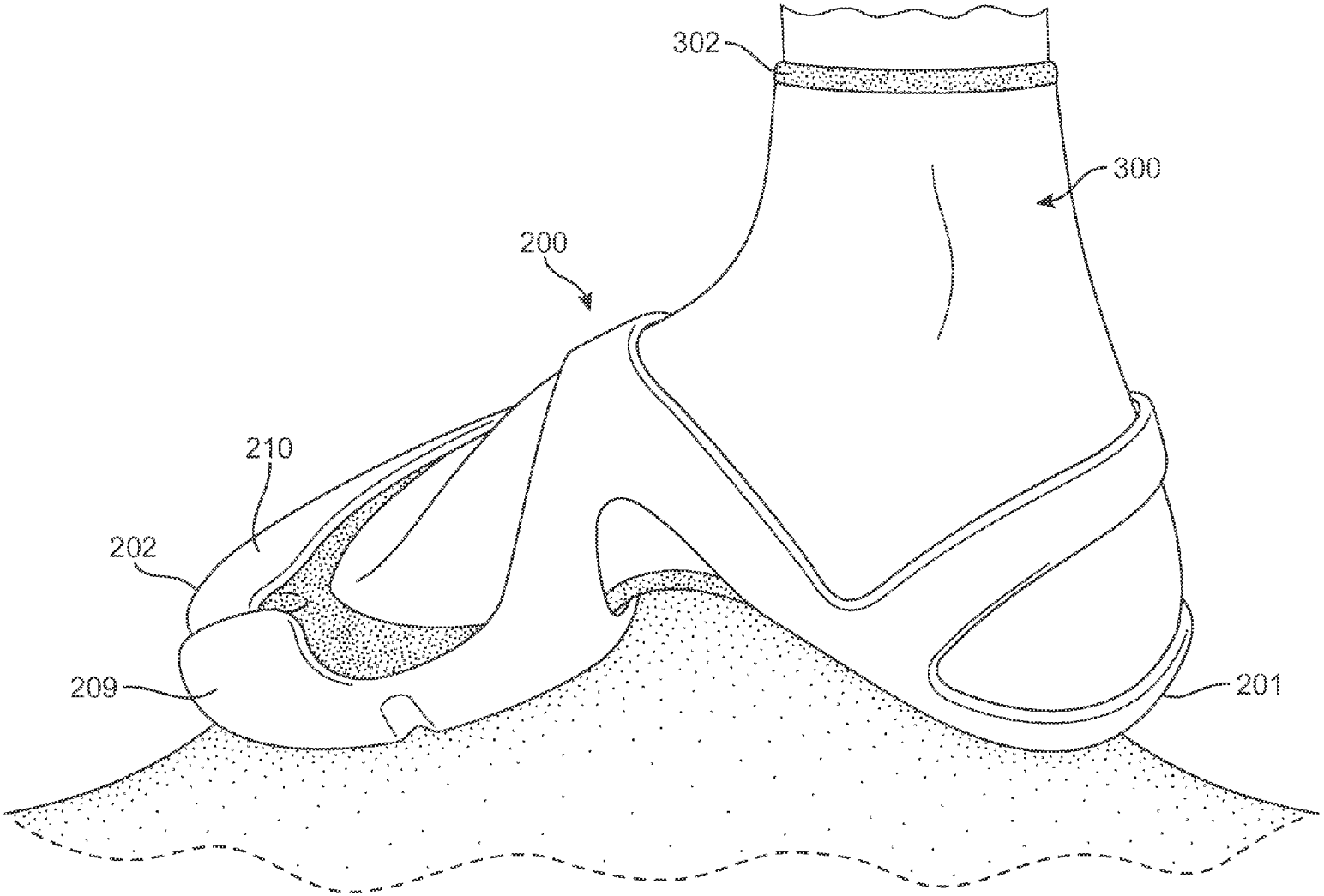
FIG. 8 is a perspective view of an embodiment of the footwear, showing how the footwear accommodates to bumps in a sand surface.

In the embodiment shown in FIGS. 2-3, sole component 200 includes a bridge 208, discussed in further detail below, which arches over the wearer's instep and connects the forefoot portion of the sole to the heel portion. This structure leaves gap 215 under the wearer's instep, such that this part of sole component 200 completely separates forefoot portion 202 from heel portion 201; that is, the entire forefoot portion is not connected to the entire heel portion via any structure, as shown in FIG. 6, maximizing flexibility for the article of footwear and allowing the article to accommodate an uneven or bumpy surface, as shown in FIG. 8.

In some embodiments, heel support portion 213 and the forefoot support portion 214 of sole component 200 may be connected via bridge 208. Generally, the geometry of bridge 208 may vary from one embodiment to another. In some embodiments, bridge 208 may have an x-like geometry. In other embodiments, bridge 208 may be characterized as having other geometries.

Figure 9:
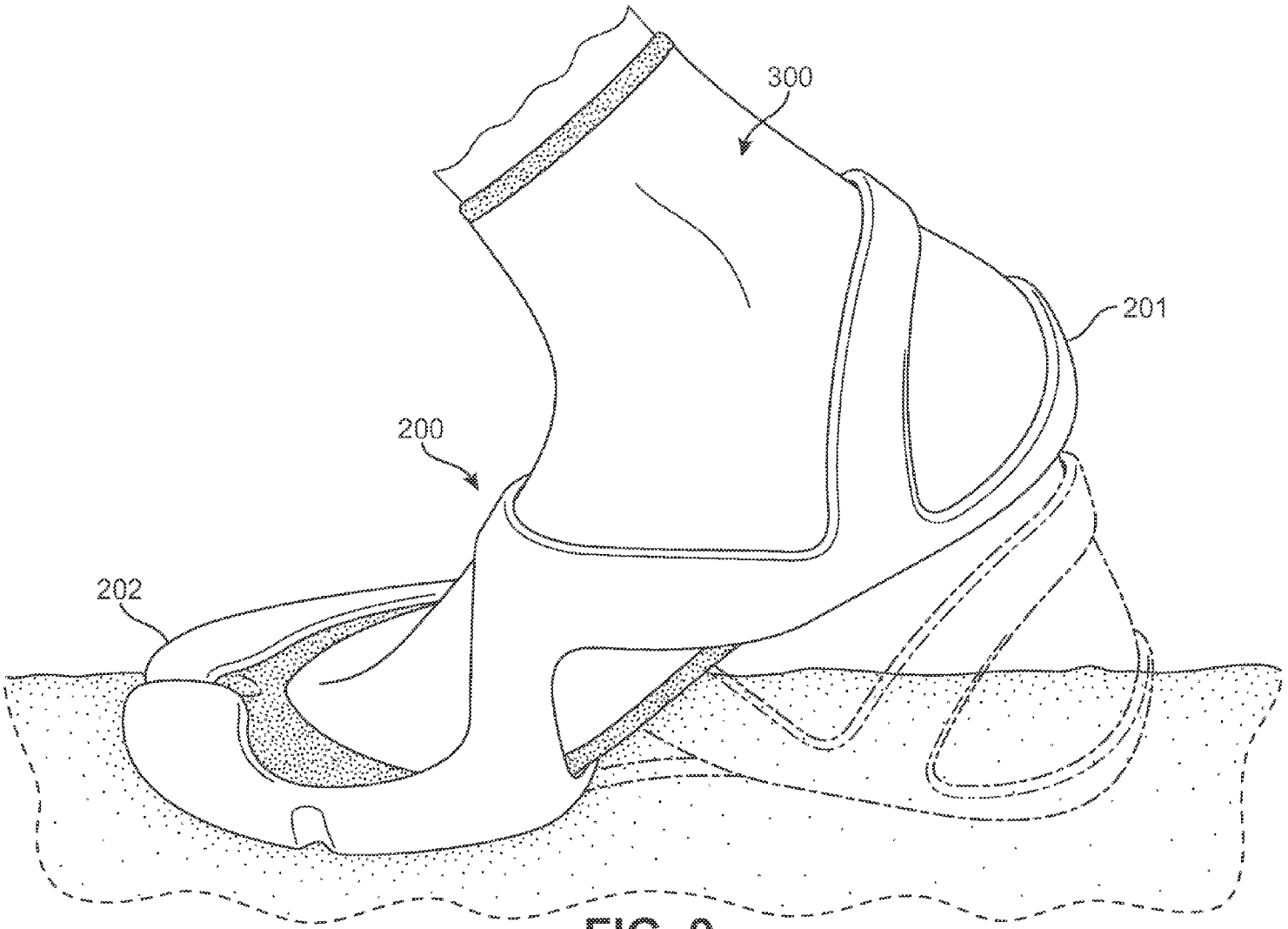
FIG. 9 is a perspective view of an embodiment of the footwear, showing how the split shoe allows unimpeded foot flexion.

In some embodiments, the x-shaped bridge 208 may be characterized by four arms. For example, on the medial side of sole component 200, x-shaped bridge 208 may have a first arm 206 that extends from the apex 216 of the x-shaped bridge 208 to the rearward end 217 of the medial side of forefoot support portion 214. The x-shaped bridge 208 may also include a second arm 204 that extends from the apex 216 of x-shaped bridge 208 to the forward end 218 of the medial side of heel support portion 213. On the lateral side of sole component 200, x-shaped bridge 208 may have a third arm 207 (shown in FIG. 3) that extends from the apex 216 of x-shaped bridge 208 to the rearward end 219 of the lateral side of forefoot support portion 214, and a fourth arm 205 that extends from the apex 216 of x-shaped bridge 208 to the forward end 220 of the lateral side of heel support 213. Thus, x-shaped bridge 208 arches over the wearer's instep, leaving gap 215 between the forefoot portion 214 of sole component 200 and the heel portion 213 of the sole. In some embodiments, medial arm 204 and medial arm 206 extend in part down the side of the wearer's foot and the lateral arm 205 and lateral arm 207 extend in part over the top of the wearer's foot. This configuration allows the article of footwear to accommodate to a bumpy surface, and also provides less resistance when the article of footwear bends during play, as shown in FIG. 9, for example.

In the embodiment shown in FIGS. 2 and 3, the split sole is a unitary product that is formed as one unit, without any seams, adhesives or stitches. Methods for making such a unitary sole construction are discussed in further detail below. However, in other embodiments, a split sole could be formed from multiple separate components that are joined using any method, such as by seams, adhesives and/or stitches. Moreover, while some embodiments comprise a unitary sole unit that is made of a single material, still other embodiments could comprise a unitary sole unit that is made of two or more distinct materials.

Figure 4:
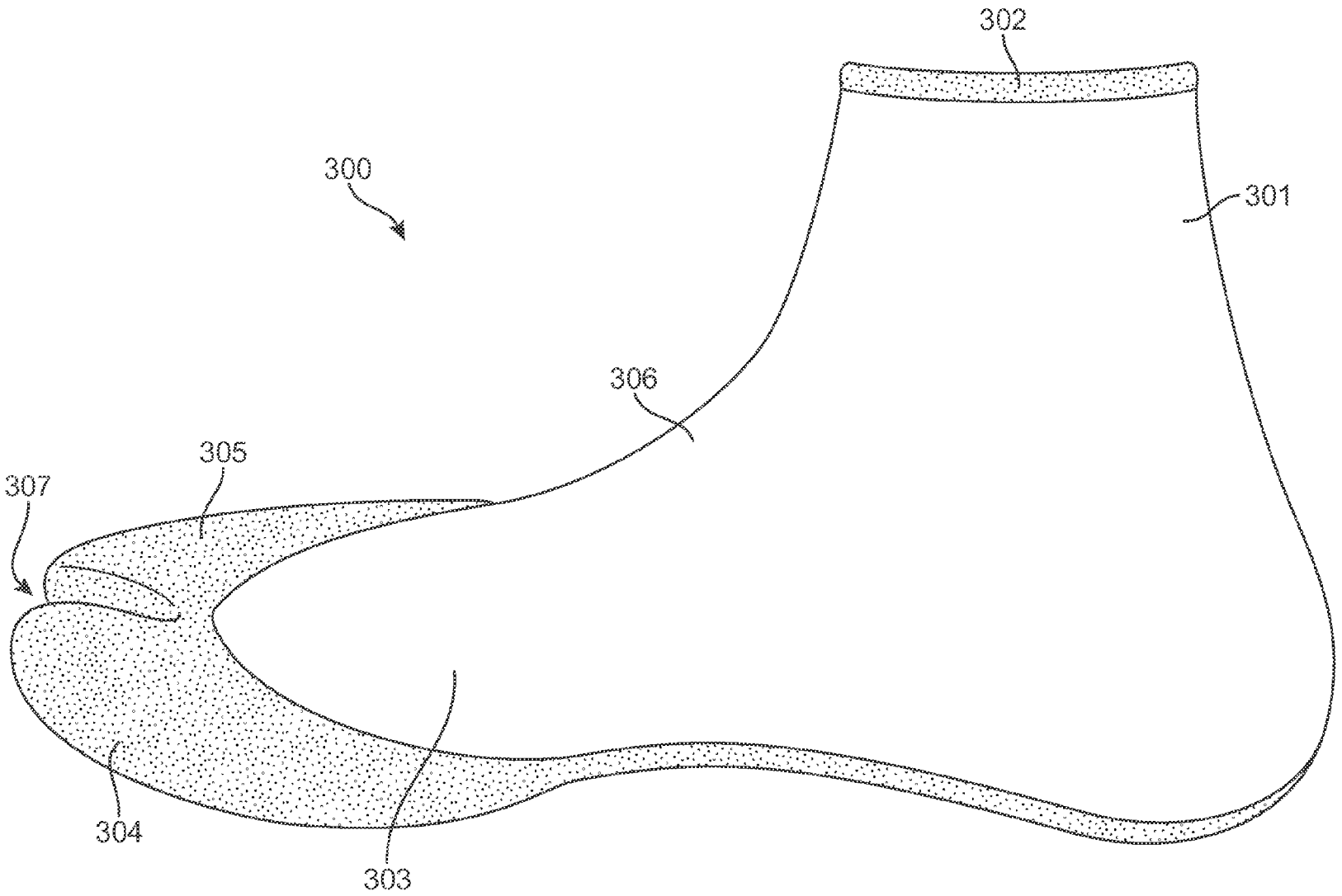
FIG. 4 is a side perspective view of an embodiment of the upper component of the footwear.
Figure 5:
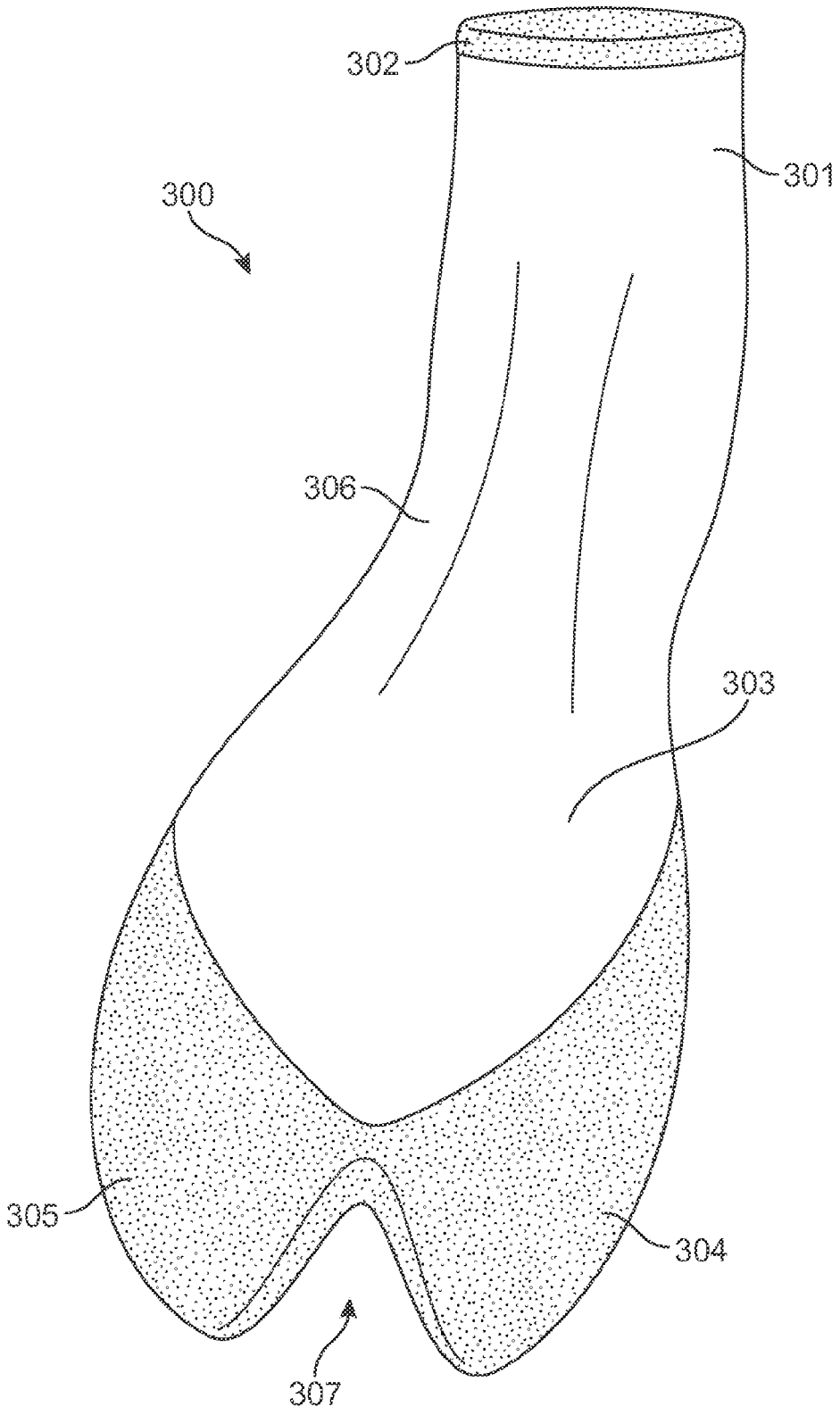
FIG. 5 is a front perspective view of an embodiment of the upper component of the footwear.

FIGS. 4 and 5 show sock upper component 300 corresponding to the embodiment of sole 200 shown in FIGS. 1 and 2. Referring to FIGS. 4 and 5, sock upper component 300 may comprise various different regions or portions including ankle portion 301, which may be joined to foot portion 303 via instep portion 306. Sock upper component 300 may further include opening 302, which is provided so that a wearer may insert his or her foot into upper 300 via opening 302.

Sock upper component 300 may incorporate provisions for separating two or more adjacent toes. In some embodiments, front medial portion 304 and front lateral portion 305 are separated from each other by an inwardly curving portion 307 of the perimeter at the front of the forefoot. In some cases, inwardly curving portion 307 may provide a gap or spacing between the big toe and adjacent toes of a foot. Moreover, as described below, inwardly curving portion may be aligned and associated with a corresponding gap of sole component 200.

FIG. 6 is a bottom view of an embodiment of sole component 200, showing forefoot section 401 and heel section 403. In some embodiments, forefoot section 401 and heel section 403 may be associated with forefoot portion 202 and heel portion 201, respectively, although they may be also associated with other embodiments.

A sole component may be configured with provisions on a bottom side, or ground contacting surface, for enhancing functionality of the footwear. In some embodiments, a ridge pattern and the materials used in making portions of the sole may be selected to maximize the abrasion resistance for those parts of the sole that are most subject to abrasion. Exemplary ridge patterns, described in further detail below, may also be configured to maximize traction against a playing surface, especially at the forefoot portion of the sole. Some embodiments include ridge patterns at the heel to improve the wearer's ability to pivot on his or her heel, while providing traction for lateral movements. In this embodiment, the ridge pattern may also include channels that allow grains of sand to be dispersed from the bottom of the sole during play.

The foregoing advantages are achieved by selecting the materials and ridge structures for the sole that maximize abrasion resistance and traction under the big toe, that allow the heel to pivot and that shed sand from the bottom of the sole. In particular, the portion of the sole under the big toe is particularly important, because in sports or games such as beach volleyball traction under the big toe is critical to performance. Thus, in some embodiments, forefoot section 401 includes toe pad 402, which may include features or provisions that differ from some other portions of forefoot section 401. For example, in some cases, toe pad 402 may be made of a material that is more abrasion-resistant and harder than the remainder of the bottom surface of forefoot section 401. Furthermore, in some cases, toe pad 402 may be associated with a substantially different traction pattern than some other portions of forefoot section 401 and/or heel section 403. In one embodiment, toe pad 402 includes ridges 411 for improved traction. Generally, the configuration of ridges 411 could vary in any manner. In some embodiments, ridges 411 may be configured as a concentric ridge pattern. In the embodiment shown in FIG. 6, the concentric ridges 411 are roughly pie-shaped (i.e., shaped as an arc from the ends of which two symmetrical straight radii converge to a point at the center), but other designs may also be used, such as circular or rectangular designs, or other designs.

Ridges 411 may function to increase the traction beneath the toe of the wearer, so as to improve the ability of the wearer to lunge forward or leap upward during a match or a game. In the embodiment shown in FIG. 6, the remainder of forefoot section 401 is fabricated with a generally rectangular ridge pattern 409, having longitudinal channels 412 and lateral channels 413. These channels may provide improved traction, and also allow sand, for example, to disperse from the bottom of the footwear during use.

In some embodiments, the material properties of different portions of sole component 200 could vary. In some embodiments, toe pad 402 may be made from a material having a higher hardness, greater abrasion resistance and/or less resilience than the material used for the fabrication of the remainder of the forefoot, which includes the portions associated with ridge pattern 409. With such an arrangement, toe pad 402 may better facilitate lunging and leaping, while the remainder of the forefoot may be more resilient than toe pad 402, thus providing improved cushioning and energy return.

In some embodiments, forefoot section 401 also has a gap 410 between the big toe and the remaining toes, thus allowing for greater flexibility by the big toe. In some cases, gap 401 corresponds roughly to inwardly curving perimeter 307 of at the front of the forefoot. Together, gap 410 and inwardly curving perimeter 307 may cooperate to provide the flexibility needed to allow the big toe to push down hard into the sand when the wearer is lunging or leaping.

As seen in FIG. 6, in some embodiments the maximum width of forefoot section 401 may optionally be substantially wider than the maximum width of heel section 403. In some embodiments, for example, forefoot section 401 is at least 15% wider than heel portion 403 but no more than 40% wider than heel portion 403. Having a relatively narrow heel improves pivoting, and having a wider forefoot allows the player to leap or lunge more effectively, since the forefoot would have greater support. Of course the relative widths of forefoot section 401 and heel section 403 could vary in any manner. In other embodiments, forefoot section 401 and heel section 403 could have substantially similar maximum widths. In still other embodiments, heel section 403 could have a substantially wider maximum width than the maximum width of forefoot section 401.

In the embodiment shown in FIG. 6, heel section 403 of split sole 200 includes a generally arcuate forward ridge section 408 and an inner heel rear ridge section 407 having incomplete oval ridges 404. Circular trough 405 is roughly located at the centerline of the heel, and longitudinal channel 406 extends forward from the forward end of the circular trough. The generally arcuate and circular configuration of the ridges in the heel of the split sole improve traction and may also allow for improved pivoting by the wearer, when the wearer is leaning heavily on the heel section of the footwear.

Figure 7:
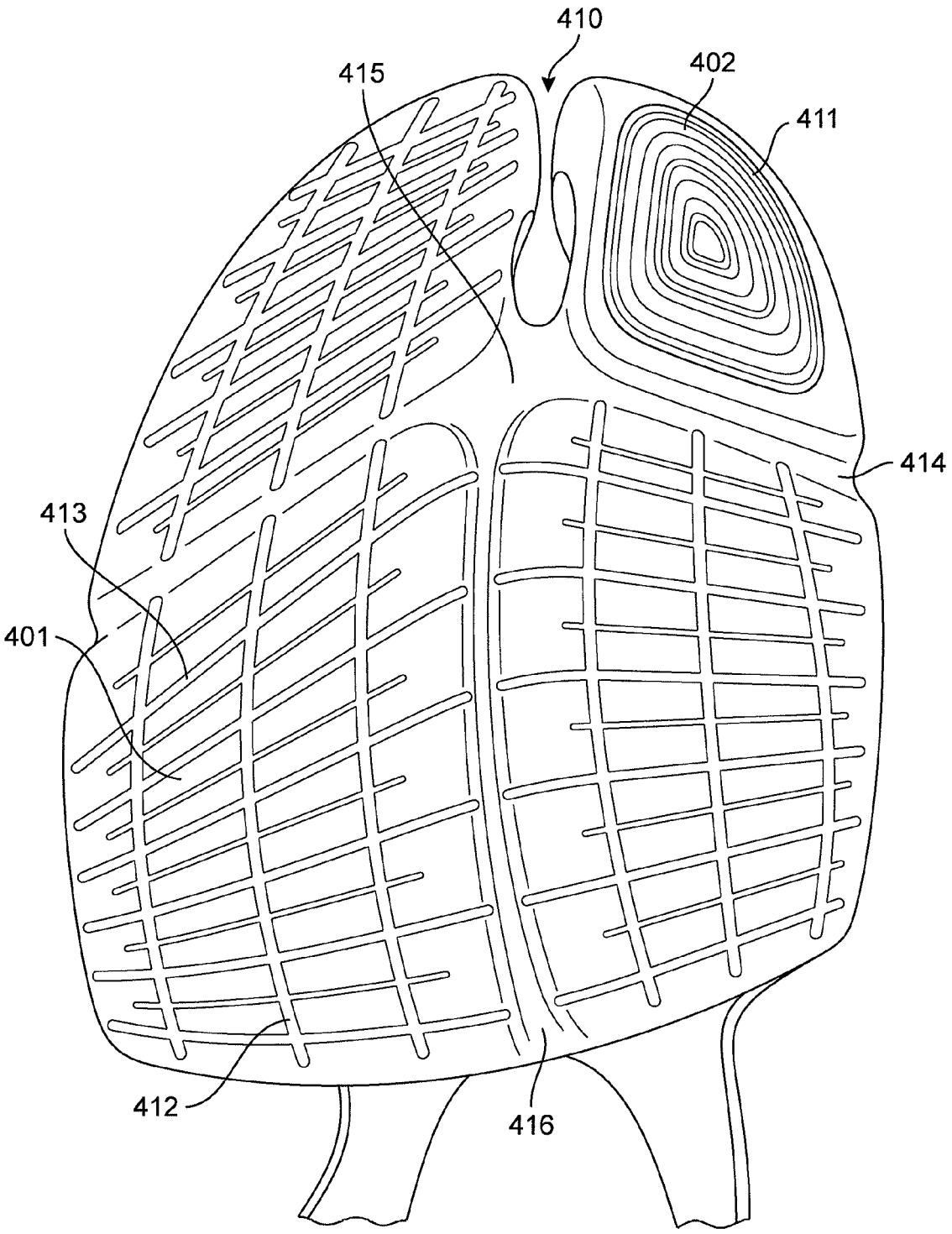
FIG. 7 is a bottom view of an embodiment of the footwear showing the forefoot section of the sole.

FIG. 7 is an enlarged bottom view of the forward forefoot portion 401 of an embodiment of article of footwear 100. Referring to FIG. 7, various features of forefoot portion 401 facilitate improved utility for article of footwear 100. For example, some embodiments can include features that help maximize flexibility at the toes. In one embodiment, forefoot portion 401 may include forward lateral channel 414 (placed behind the big toe) that extends across the width of forefoot portion 401. In some cases, forward lateral channel 414 may cooperate with longitudinal gap 410 to maximize the flexibility of the big toe in relation to the remainder of the forefoot.

Forefoot portion 401 may also include provisions for channeling sand or other particles away from the ridge structure and towards more open areas such that they can be shed from the sole. In some embodiments, forefoot portion 401 may include central longitudinal channel 416, which intersects with forward lateral channel 414 to form a roughly diamond-shaped depression 415. In some cases, diamond-shaped depression 415 may improve the ability of the sole to shed sand or other particles that have flowed or been propelled towards depression 415. Although the current embodiment uses a diamond-shaped depression, in other embodiments a depression could have any other shape including, but not limited to rounded, oval, or triangular shapes, as well as other generally polygonal or rounded shapes.

FIG. 8 is a perspective view of an embodiment of the footwear, showing how the footwear accommodates to bumps in a sand surface. In this example, the footwear arcs over the bump in the sand allowing the wearer to maintain full contact with the sand at both the forefoot and the heel. FIG. 8 also shows how protective element 209 and protective element 210 serve to protect the wearer's foot from abrasion. Specifically, protective element 209 and protective element 210 cover those parts of the foot that are most likely to come into abrasive contact with the sandy surface, and thus need to be protected.

FIG. 9 is a perspective view of an embodiment of the footwear, showing how the split shoe allows unimpeded foot flexion. The outline in dashed lines of the rear part of the footwear represents the footwear when the wearer's foot is flat against the ground, and the solid lines represent the footwear when the wearer is lunging or leaping, with the heel pointing upwards and the forefoot portion pressed firmly into the sand.

FIGS. 1, 8 and 9 also show that the footwear may be made as an integral product in which the split sole has been fabricated using molding material that has impregnated the textile of the sock upper, as described below. One possible method for making components of article 100 is described here. However, the embodiments of article of footwear 100 are not intended to be limited to a particular method of making or forming various components and other embodiments could make use of any methods known in the art for forming upper and sole components.

In one embodiment of a method for making an article, article of footwear 100 is fabricated by preparing textile sock upper component 300 using techniques known in the textile art. Upper sock component 300 is then fitted over a last, and the last is placed in a mold. Molding material is then injected into the mold to form sole component 200. The molding material impregnates the sock upper such that an integral article of footwear is fabricated.

Figure 10:
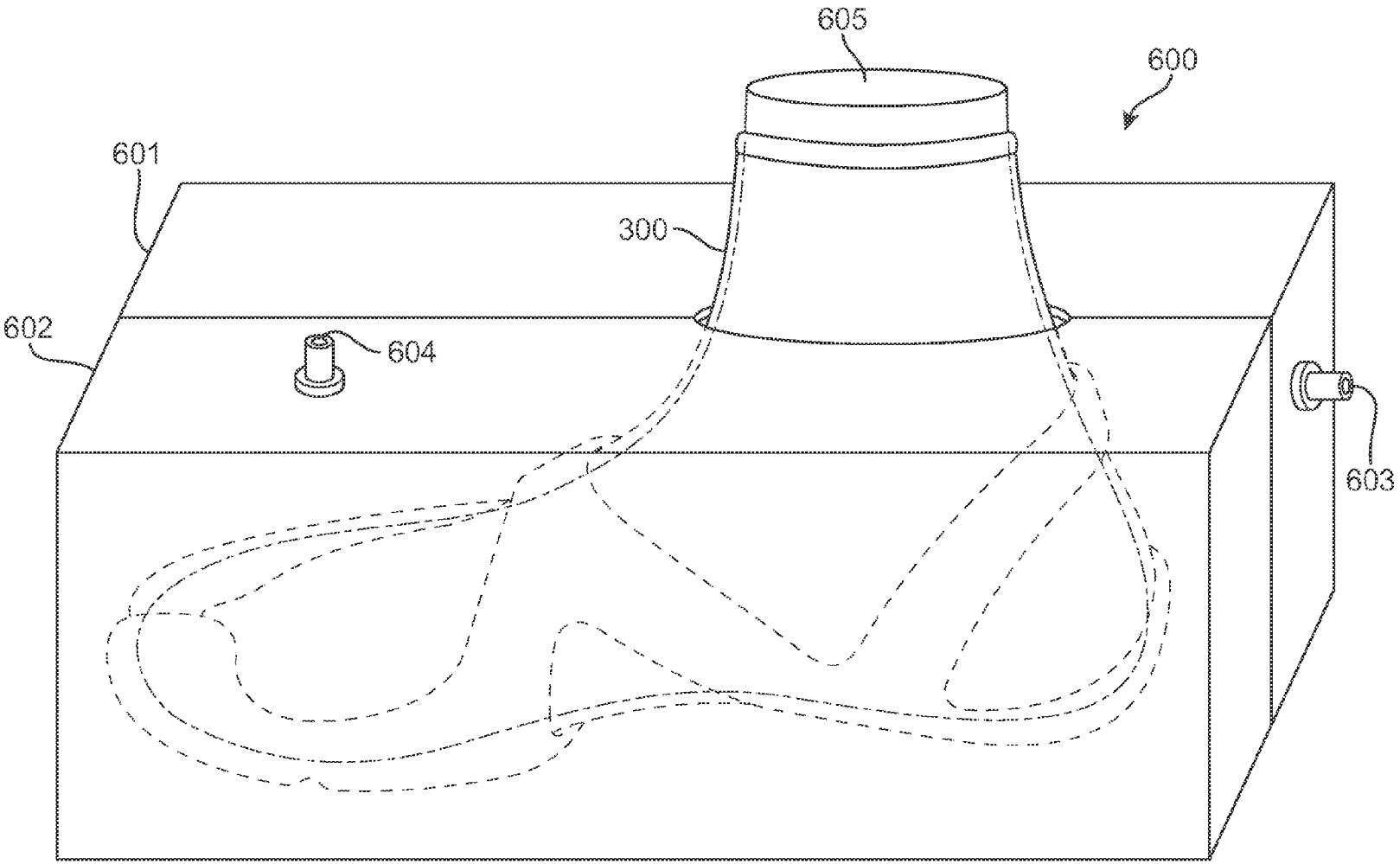
FIG. 10 is a perspective view showing an injection mold for manufacturing the footwear.

FIG. 10 shows an example of an injection mold that can be used to manufacture the footwear described above. In this figure, sock upper component 300 has been fitted over a last 605 modeling a foot, i.e., over a form. Last 605 with the sock upper component 300 is then inserted into one side 601 of a mold 600 having the complement to the desired shape and structure of the split sole engraved on the inner surfaces of the mold, and the other side 602 of the mold is clamped onto the form. Molding material is then injected into the mold through port 603 and port 604, for example, as well as other ports (not shown) using molding techniques well-known to one of ordinary skill in the art. Article 100 is then allowed to cool down and solidify, then is removed from the mold and finished, as is known to one of ordinary skill in the art.

Some embodiments may include provisions for maximizing contact between the bottom of a sole and a playing surface. In some embodiments, for example, the lower or ground-contacting portion of a sole can be somewhat flexible in order to adapt to the shape of the ground surface for maximizing contact, which can increase traction and control.

Figure 11:
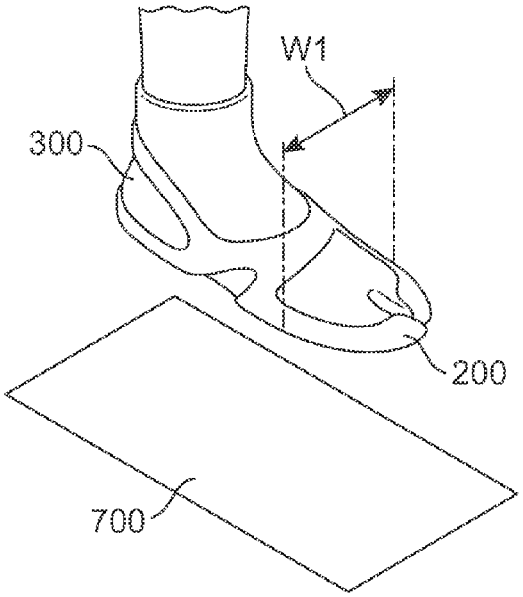
FIG. 11 is a schematic isometric view of an embodiment of an article with a sole disposed over a playing surface.
Figure 12:
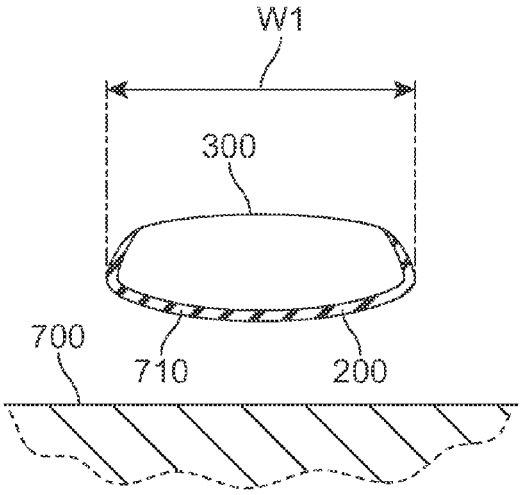
FIG. 12 is a schematic front cross-sectional view of the article and playing surface of FIG. 11.
Figure 13:
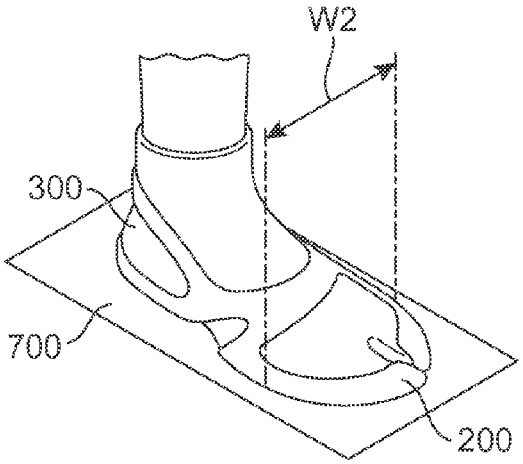
FIG. 13 is a schematic isometric view of an embodiment of an article with a sole in contract with a playing surface.
Figure 14:
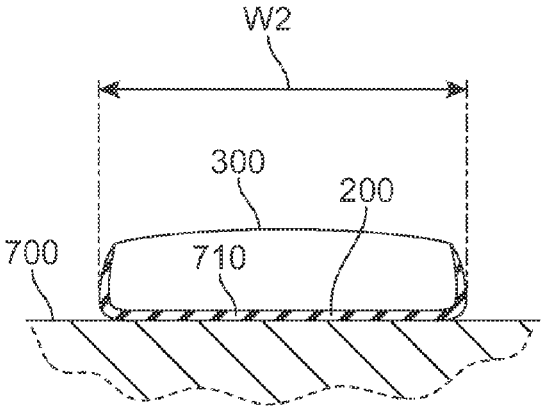
FIG. 14 is a schematic front cross-sectional view of the article and playing surface of FIG. 13.

FIGS. 11-14 illustrate an embodiment of the footwear, showing how the footwear may conform to the contours of the playing surface. In particular, FIGS. 11 and 12 show an isometric view of sole component 200 positioned above a playing surface 700 as well as a front cross-sectional view of sole structure 200 and playing surface 700 in the same relative position, respectively. Also, FIGS. 13 and 14 show an isometric view of sole component 200 in contact with playing surface 700 as well as a cross-sectional view of sole component 200 and playing surface 700 in contact.

As illustrated in FIGS. 11 and 12, sole component 200 of the footwear exhibits a certain degree of curvature. In some embodiments, a lower portion 710, which may be a ground-contacting portion, of sole component 200 is a contoured portion. In some embodiments, lower portion 710 may be a substantially convex portion. In other embodiments, however, lower portion 710 could be a substantially concave portion. In still other cases, lower portion 710 could be a substantially flat portion.

In some embodiments, sole component 200 may be substantially flexible enough so that sole component 200 conforms to the shape of a corresponding surface. For example, as seen in FIGS. 13 and 14, sole component 200 may be flexible enough to flatten against playing surface 700. As seen specifically in FIG. 14, lower portion 710 may temporarily take on an approximately flat geometry when contacting the substantially flat playing surface 700. This flexibility allows for an increased contact area between sole component 200 and playing surface 700. In particular, the contact area between sole component 200 and playing surface 700 may be substantially increased over the contact area that would occur between playing surface 700 and a rigid member having a similar geometry to sole component 200 in the non-deformed state of FIG. 12. This may maximize traction with a playing surface and provide increased control for a wearer.

Figure 15:
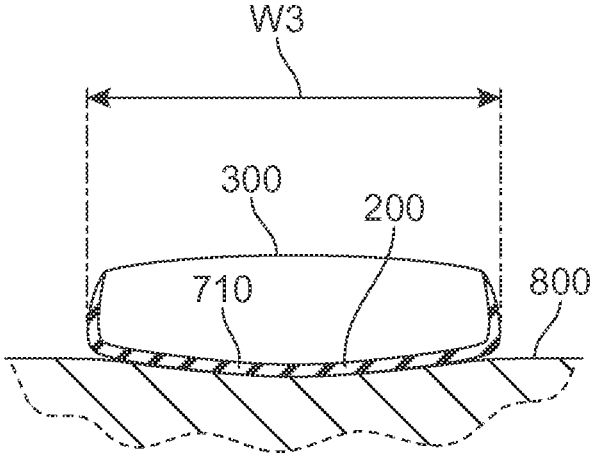
FIG. 15 is a schematic front cross-sectional view of an embodiment of an article in contact with a contoured playing surface.

In another situation where a playing surface is not flat, sole component 200 may conform to the contours of the playing surface. For example, FIG. 15 illustrates a front cross-sectional view of sole 200 in contact with contoured playing surface 800. In this case, lower portion 710 of sole component 200 flexes in order to adapt to the contours of playing surface 800. This may maximize traction with a playing surface and provide increased control for a wearer.

As the geometry of lower portion 710 changes, the width of sole component 200 may change. In some embodiments, as sole component 200 flattens against a playing surface, the width of sole 200 may be increased. For example, in the initial configuration shown in FIG. 12, sole component 200 has a width W1. As sole component 200 flattens against playing surface 700, the width adjusts from width W1 to width W2 (see FIG. 14), which may be substantially greater than width W1. Similarly, the width of sole component 200 may also change as sole component 200 confronts contoured playing surfaces. For example, in configuration of FIG. 15, sole component 200 has a width W3 that may be substantially different than width W1. For surfaces whose curvature is greater than the curvature of lower portion 710, the width of sole component 200 could decrease. For surfaces whose curvature is less than the curvature of lower portion 710, the width of sole component 200 could increase.

In order to accommodate changes in shape and width, upper component 300 may be substantially flexible as well. In some embodiments, the fabric or material used at least in the forefoot portion of upper component 300 in the embodiment shown in FIGS. 11-15 is a stretchable fabric that allows the sole to expand to some degree, as shown in these figures.

While various embodiments have been described above, the description is intended to be exemplary, rather than limiting. It will be apparent to those of ordinary skill in the art that additional embodiments and implementations are possible. Accordingly, the embodiments are not to be restricted except in light of the attached claims and their equivalents.

What is claimed is:

1. An article of footwear comprising:

a sock upper component;

a sole component comprising a split sole having a forefoot portion and a heel portion separated by a gap between the forefoot portion of the split sole and the heel portion of the split sole, the gap completely separating the forefoot portion from the heel portion such that the gap defines a void that laterally extends the entire width of the sole component from a medial side to a lateral side, allowing the sock upper component to be exposed throughout the gap from the medial side to the lateral side of the sole component when viewed from a ground-engaging surface;

an integral x-shaped bridge that bridges over the gap and is configured to arch over a wearer's instep, wherein the x-shaped bridge connects the forefoot portion of the split sole to the heel portion of the split sole by extending arms to curve over the wearer's instep to connect with the forefoot portion on its lateral side, the forefoot portion on its medial side, the heel portion on its lateral side and the heel portion on its medial side;

a lateral front protective element configured to curve around a lateral side of the forefoot portion to provide protection at the lateral side of the forefoot portion and a medial front protective element configured to curve around a medial side of the forefoot portion to provide protection at the medial side of the forefoot portion, wherein the lateral front protective element and the medial front protective element are also configured to leave a substantial opening at a dorsal surface of the wearer's foot;

a back strap attached to the split sole configured to wrap around a wearer's heel; and wherein the article of footwear is a unitary component with the split sole integrally attached to the sock upper component.

2. The article of footwear of claim 1, wherein the forefoot portion of the split sole has a longitudinal gap, and wherein the longitudinal gap separates a portion of the split sole configured to lie under a wearer's big toe from a portion of the split sole configured to lie under a wearer's remaining toes.

3. The article of footwear of claim 1, wherein the back strap is attached at one end to the medial side of the heel portion of the split sole and at the other end to the lateral side of the heel portion of the split sole.

4. The article of footwear of claim 1, wherein the forefoot portion comprises a toe pad configured to lie under a wearer's big toe, wherein the toe pad comprises ridges.

5. The article of footwear of claim 4, wherein the toe pad comprises a concentric ridge pattern.

6. The article of footwear of claim 1, wherein the heel portion of the split sole comprises ridges towards the front of the heel portion, a circular trough located to the rear of the ridges and approximately on a centerline of the heel portion, and a longitudinal channel extending forward from the circular trough along the centerline of the heel portion, wherein the ridges are in the form of arc segments.

7. An article of footwear comprising:

a textile sock upper component;

an integral split sole having a forefoot portion and a heel portion separated by a gap between the forefoot portion of the split sole and the heel portion of the split sole configured to lie beneath a wearer's instep; the gap completely separating the forefoot portion from the heel portion such that the gap defines a void that laterally extends the entire width of the integral split sole from a medial side to a lateral side, allowing the textile sock upper component to be exposed throughout the gap from the medial side to the lateral side of the integral split sole when viewed from a ground-engaging surface;

a back strap configured to wrap around a wearer's heel and attached at one end to a medial side of the heel portion and at the other end to a lateral side of the heel portion;

an integral x-shaped bridge that bridges over the gap and is configured to curve over a wearer's foot comprising an apex configured to lie over the wearer's instep, the apex comprising a portion from which a first arm extends from the apex to a medial side of the forefoot portion of the split sole and a second arm extends from the apex to a medial side of the heel portion of the split sole, a third arm extends from the apex to a lateral side of the forefoot portion of the split sole and a fourth arm extends from the apex to a lateral side of the heel portion of the split sole, wherein the first arm and the second arm are configured to extend in part down the side of the wearer's foot and the third arm and the fourth arm are configured to extend in part over the top of the wearer's foot;

wherein the first arm and the second arm form an arch over the gap and connect the medial side of the forefoot portion of the split sole to the medial side of the heel portion of the split sole; and wherein the third arm and the fourth arm form an arch over the gap and connect the lateral side of the forefoot portion of the split sole to the lateral side of the heel portion of the split sole;

a lateral front protective element configured to curve around a lateral side of the forefoot portion of a wearer's foot to provide protection at the lateral side of the wearer's foot, and a medial front protective element configured to curve around a medial side of the wearer's foot to provide protection at the medial side of the wearer's foot, wherein the lateral front protective element and the medial front protective element are configured to leave a substantial opening at a dorsal surface of the wearer's foot, wherein the split sole is a unitary product, and wherein the textile sock upper component comprises impregnated molding material.

8. The article of footwear of claim 7, wherein the split sole has a bottom side, wherein the bottom side of the split sole comprises a toe pad, wherein the toe pad comprises ridges, and the ridges form a pattern of closed concentric rounded triangular designs.

9. The article of footwear of claim 7, wherein the split sole has a bottom side, and wherein a portion of the bottom side of the forefoot of the split sole comprises a ridge pattern having longitudinal and lateral channels.

10. The article of footwear of claim 7, wherein the split sole has a bottom side, and wherein the bottom side of the split sole comprises a circular trough located at approximately a centerline of the heel portion of the split sole, comprising a longitudinal channel extending forward from the forward end of the circular trough along the centerline of the heel portion.

11. The article of footwear of claim 7, wherein the width of the forefoot portion is substantially greater than the width of the heel portion of the split sole.

12. An article of footwear comprising:

a textile sock upper component;

an integral split sole having a forefoot portion and a heel portion separated by a gap between the forefoot portion and the heel portion, the gap completely separating the forefoot portion from the heel portion such that the gap defines a void that laterally extends the entire width of the integral split sole from a medial side to a lateral side, allowing the textile sock upper component to be exposed throughout the gap from the medial side to the lateral side of the integral split sole when viewed from a ground-engaging surface;

wherein the forefoot portion comprises a lateral front protective element configured to curve around a lateral side of the forefoot portion and a medial front protective element configured to curve around a medial side of the forefoot portion, wherein the lateral front protective element and the medial front protective element are configured to leave a substantial opening at a dorsal surface of a wearer's foot;

a back strap attached to the heel portion of the integral split sole, wherein the back strap is configured to wrap around a wearer's heel;

an integral x-shaped bridge configured to bridge over the gap and to fit over the wearer's foot at a wearer's instep, the x-shaped bridge comprising first, second, third and fourth arms extending downwards from an apex of the x-shaped bridge to attach to the forefoot portion and the heel portion of the sole, wherein the first arm extends down to attach to a medial side of the forefoot portion, the second arm extends down to attach to a medial side of the heel portion, the third arm extends down to attach to a lateral side of the forefoot portion and the fourth arm extends down to attach to a lateral side of the heel portion, and wherein the split sole and the textile sock upper component form an integral product.

13. The article of footwear of claim 12, wherein the first arm is configured to extend primarily along a medial side of the wearer's foot and the third arm is configured to extend in part over the wearer's foot.

14. The article of footwear of claim 12, wherein the back strap is integrally attached at a first end to the medial side of the heel and is also integrally attached at a second end to the lateral side of the heel.

15. The article of footwear of claim 12, wherein the forefoot portion comprises a toe pad having a pattern of concentric arcuate ridges at its bottom side.

16. The article of footwear of claim 12, wherein the heel portion comprises a circular trough and further comprises a longitudinal channel extending forward from the circular trough along a centerline of the heel portion of the sole.

17. An article of footwear comprising:

a split sole and a textile sock upper;

wherein the split sole comprises a forefoot portion and a heel portion separated by a gap, the gap completely separating the forefoot portion from the heel portion such that the gap defines a void that laterally extends the entire width of the split sole from a medial side to a lateral side, allowing the textile sock upper to be exposed throughout the gap from the medial side to the lateral side of the integral split sole when viewed from a ground-engaging surface; an integral x-shaped bridge having an apex and first, second, third, and fourth arms, the integral x-shaped bridge configured to bridge over the gap and to curve over a wearer's instep, wherein the first arm attached to a medial side of the forefoot portion, the second arm attaches to a medial side of the heel portion, the third arm attaches to a lateral side of the forefoot portion and the fourth arm attaches to a lateral side of the heel portion, wherein the first arm and the second arm form an arch over the gap and connect the medial side of the forefoot portion of the split sole to the medial side of the heel portion of the split sole; and wherein the third arm and the fourth arm form an arch over the gap and connect the lateral side of the forefoot portion of the split sole to the lateral side of the heel portion of the split sole;

a back strap attached to the heel portion of the integral split sole and configured to wrap around the wearer's heel;

wherein the textile sock upper comprises an ankle portion and an instep portion, and wherein surfaces of the textile sock upper in contact with the split sole are impregnated with molding material.

18. The article of footwear of claim 17, wherein the textile sock upper comprises a front medial portion and a front lateral portion separated by an inwardly curving portion of the fabric sock's front perimeter.

19. The article of footwear of claim 17, wherein the textile sock upper comprises a front forefoot portion fabricated from a different material than material used to fabricate the ankle portion and the instep portion of the fabric sock upper.

20. The article of footwear of claim 17, wherein the forefoot portion comprises a toe pad comprising a pattern of concentric ridges.

21. The article of footwear of claim 20, wherein the toe pad is made from a material that is harder and less resilient than the material used for the remainder of the forefoot.

22. The article of footwear of claim 17, wherein the heel portion comprises a circular trough and a longitudinal channel extending forward from the circular trough along a centerline of the heel portion.

* * * * *